US006817967B1

(12) United States Patent
Ott et al.

(10) Patent No.: US 6,817,967 B1
(45) Date of Patent: Nov. 16, 2004

(54) ELASTIC FINGER EXERCISE DEVICE

(76) Inventors: Wolfgang Ott, 5100 Hereford Ct., Antioch, CA (US) 94531; David Adam, 234 Brushwood Pl., Brentwood, CA (US) 94513

( * ) Notice: Subject to any disclaimer, the term of this patent is extended or adjusted under 35 U.S.C. 154(b) by 0 days.

(21) Appl. No.: 10/336,181

(22) Filed: Jan. 4, 2003

Related U.S. Application Data

(60) Provisional application No. 60/348,742, filed on Jan. 17, 2002.

(51) Int. Cl.[7] ..... A63B 21/00
(52) U.S. Cl. ..... 482/48; 482/47
(58) Field of Search ..... 482/48, 44, 47, 482/49, 132, 121; 446/48

(56) References Cited

U.S. PATENT DOCUMENTS 3,612,521 A * 10/1971 Wendeborn
5,062,625 A * 11/1991 Vonk
5,492,525 A * 2/1996 Gibney
6,179,751 B1 * 1/2001 Clears
6,228,001 B1 * 5/2001 Johnson

* cited by examiner

*Primary Examiner*—Jerome W. Donnelly

(57) ABSTRACT

A finger exercise device is comprised of an elastic elongated central loop and elastic side loops attached to opposite ends of the central loop. The loops are for being worn around a plurality of fingers, and the exercise is comprised of repeatedly spreading the fingers apart against the tension of the loops. The central loop has a varying width between its opposite edges, wherein the opposite ends of the loop are wider than the intermediate portion for improved grip and comfort on the fingers. The side loops have outer ends which are wider than the inner ends for improved grip and comfort. In an alternative embodiment, the finger exercise device is comprised of a plurality of loops, and radial arms extending from a solid junction are connected to respective loops. The loops have widened outer ends for improved grip and comfort.

7 Claims, 6 Drawing Sheets

ELASTIC FINGER EXERCISE DEVICE

CROSS REFERENCE TO RELATED APPLICATIONS

We claim the benefit of provisional patent application 60/348,742 file on Jan. 17, 2002.

BACKGROUND OF THE INVENTION

1. Field of the Invention

The invention broadly relates to devices for exercising fingers.

2. Prior Art

People who use their hands for prolonged periods on repetitive tasks, such as operating computers, writing, etc., sometimes develop repetitive stress injuries (RSI). A form of therapy which has been applied to people with RSI in their hands comprises stretching a conventional thick rubber band between the fingers, and repeatedly spreading the fingers against the tension of the rubber band. However, a rubber band is difficult to use because its simple loop provides limited options for exercises. It also tends to slip off when the fingers are spread apart. Users may have to hold the rubber band with the other hand, which may also be injured.

Another form of therapy includes rolling a putty into a thick loop, positioning the fingers inside the loop, and stretching the loop with the fingers. This method is very inconvenient because the loop must be reshaped after each stretch.

U.S. Pat. No. 5,366,436 to Gibney discloses a finger exercise device comprising an elastic sheet with holes for the fingers. When exercising all five fingers simultaneously, the sheet applies tension between adjacent fingers, which is undesirable for some types of therapy. The thin sheet also tends to slip off when the fingers are spread apart.

U.S. Pat. No. 4,815,729 to Stefanski discloses a finger exercise device comprising a glove with an elastic band attached around the fingers. The disadvantage is that the glove is relatively expensive and must be made available in different sizes. U.S. Pat. No. 4,105,200 to Unger discloses a finger exercise device comprising a bar with elastic bands stretched between its ends. The fingers are limited to a single exercise by the grip on the bar.

U.S. Pat. No. 3,612,521 to Wendeborn discloses a finger exercise device comprising finger loops attached around the periphery of an elastic ring. The ring applies tension between adjacent fingers, which is undesirable for some types of therapy. The ring is the same thickness as the loops, so that the ring is too thick and provides too much tension for some users. U.S. Pat. No. 1,256,004 to Finney discloses a finger exercise device comprising an elongated frame with elastic bands across the long sides of the frame. It is limited to a single exercise because it can only apply tension when the fingers are closed toward each other.

U.S. Pat. No. 494,197 to Hall discloses a finger exercise device comprising elastic cords attached to a wrist band. Finger rings are attached to the ends of the cords. It applies tension not between the fingers, but between the fingers and the wrist.

BRIEF SUMMARY OF THE INVENTION

Accordingly, several objects of the present finger exercise device are:

to apply tension between the fingers;

to be attachable to different fingers for exercising different fingers;

to provide tension that radiate from a single position when attached to all five fingers;

to avoid slipping off when the fingers are spread apart;

to be comfortable to use;

to provide a suitable level of tension;

to help an injured hand recover; and to help a healthy hand avoid injury.

The present finger exercise device is comprised of an elastic elongated central loop and elastic side loops attached to opposite ends of the central loop. The loops are for being worn around a plurality of fingers, and the exercise is comprised of repeatedly spreading the fingers apart against the tension of the loops. The central loop has a varying width between its opposite edges, wherein the opposite ends of the loop are wider than the intermediate portion for improved grip and comfort on the fingers. The side loops have outer ends which are wider than the inner ends for improved grip and comfort. In an alternative embodiment, the finger exercise device is comprised of a plurality of loops, and radial arms extending from a solid junction are connected to respective loops. The loops have widened outer ends for improved grip and comfort.

DETAILED DESCRIPTION OF THE INVENTION

Figure 1:
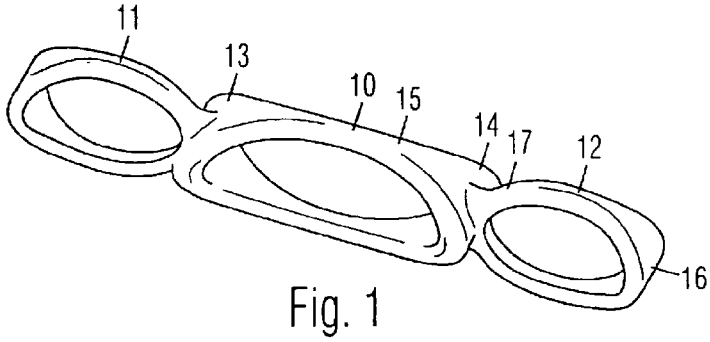
FIG. 1 is a perspective view of the present elastic finger exercise device.
Figure 2:
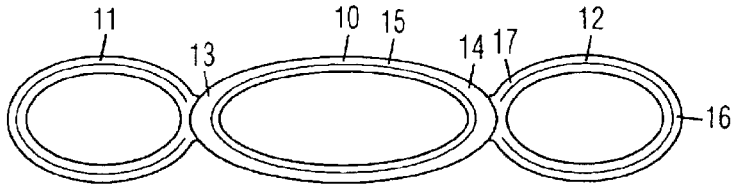
FIG. 2 is an top view thereof.
Figure 3:
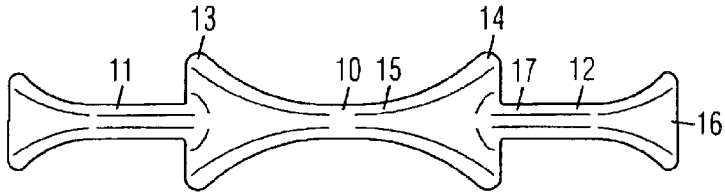
FIG. 3 is a side view thereof.

FIGS. 1–3:

A first embodiment of the present finger exercise device is shown in FIGS. 1–3. It is comprised of an elastic elongated central loop 10 and elastic side loops 11 and 12 attached to opposite ends of central loop 10. Loops 10–12 are for being worn around the tips of a plurality of fingers, and the exercise is comprised of repeatedly spreading the fingers apart against the tension of the loops. Central loop 10 is elongated enough to wrap around at least two fingers.

Each loop 10, 11, or 12 has a varying width between its opposite edges, wherein central loop 10 has wider opposite gripping ends 13 and 14 for improved grip and comfort around the fingers, and a narrower intermediate portion 15 for elongation and tension. Each side loop 11 or 12 has a wider gripping outer end 16 for improved grip and comfort around the fingers, and a narrower inner end 17 for elongation and tension. Gripping ends 13, 14, and 16 provide wider contact areas for avoiding cutting into the fingers to improve comfort. Alternatively, additional loops may be connected together, or side loops 11 and 12 may be eliminated.

Figure 4:
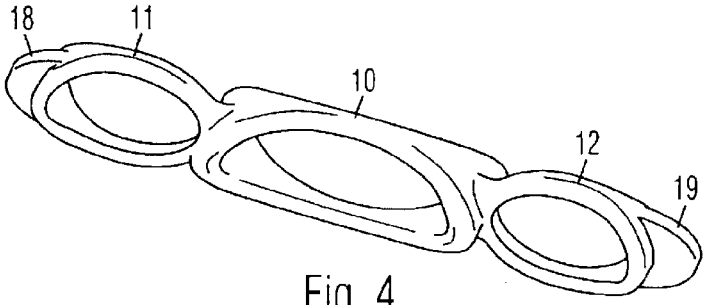
FIG. 4 is a perspective view of a second embodiment thereof.
Figure 5:
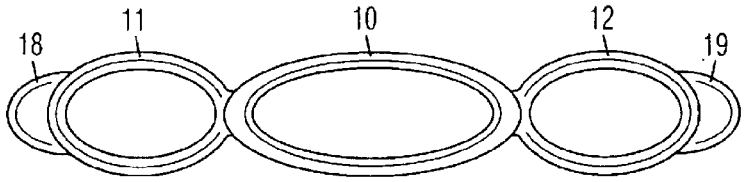
FIG. 5 is a top view of the embodiment of FIG. 4.
Figure 6:
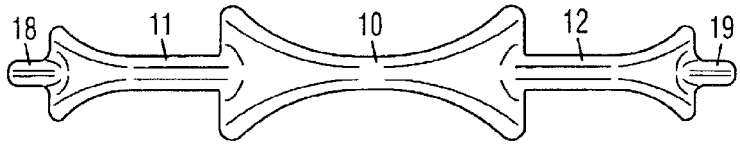
FIG. 6 is a side view of the embodiment of FIG. 4.

FIGS. 4–6:

A second embodiment of the finger exercise device is shown in FIGS. 4–6. It is comprised of the same loops 10–12 as in FIGS. 1–3, but further including tabs 18 and 19 projecting from respective gripping outer ends of side loops 11 and 12. Tabs 18 and 19 provide easily grasped surfaces when adjusting the positioning of loops 11 and 12 around the fingers.

Figure 7:
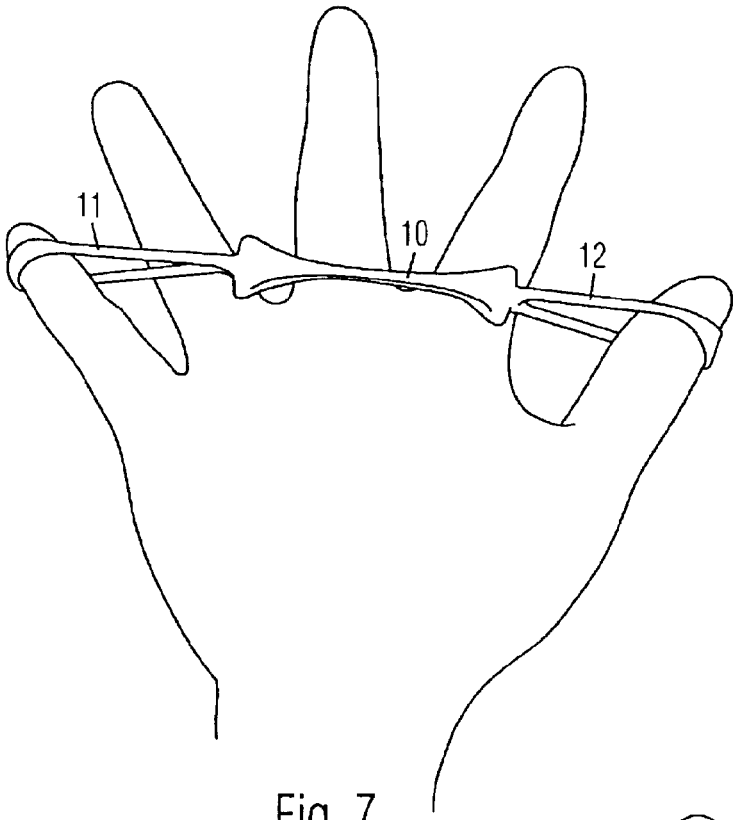
FIG. 7 shows the finger exercise device of FIG. 1 in use.
Figure 8:
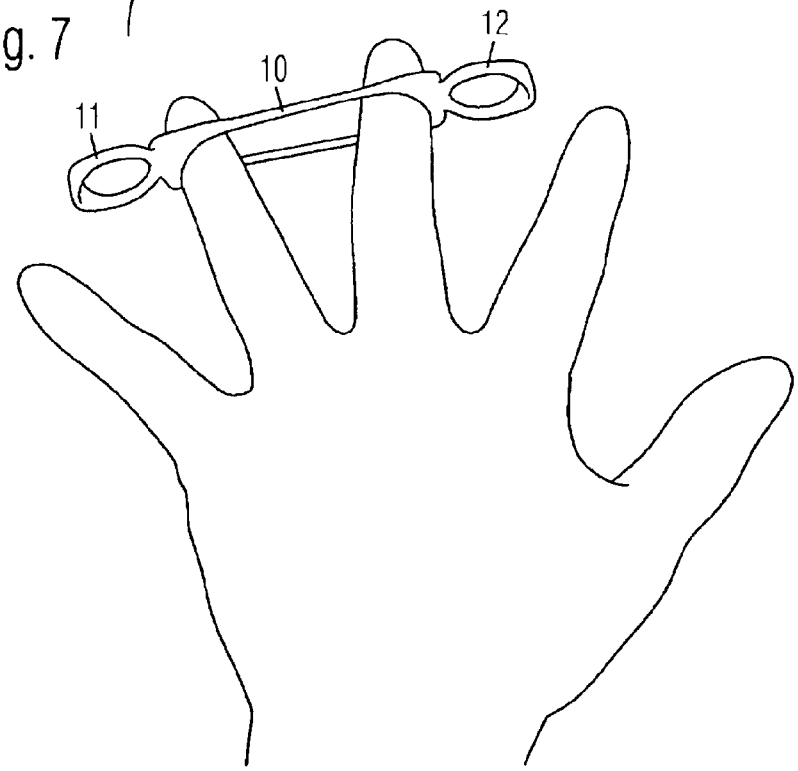
FIG. 8 shows the finger exercise device of FIG. 1 in use.

FIGS. 7–8:

The finger exercise device of FIGS. 1–3 is shown in FIGS. 7–8 in use. In FIG. 7, side loops 11 and 12 are worn around the thumb and little finger, which are repeatedly spread apart against the tension of the exercise device as physical therapy or to maintain good health. In FIG. 8, central loop 10 is worn around the middle and ring fingers for exercising two adjacent fingers. The methods of use shown in FIGS. 7 and 8 are only examples. The finger exercise device may be used in many other ways.

Figure 9:
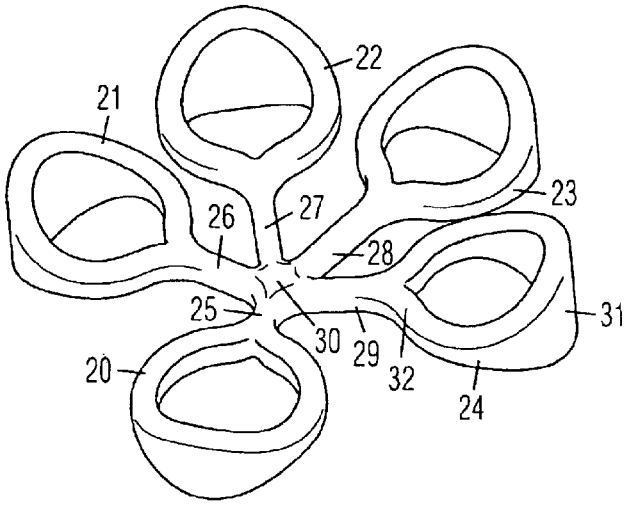
FIG. 9 is a perspective view of a third embodiment thereof.
Figure 10:
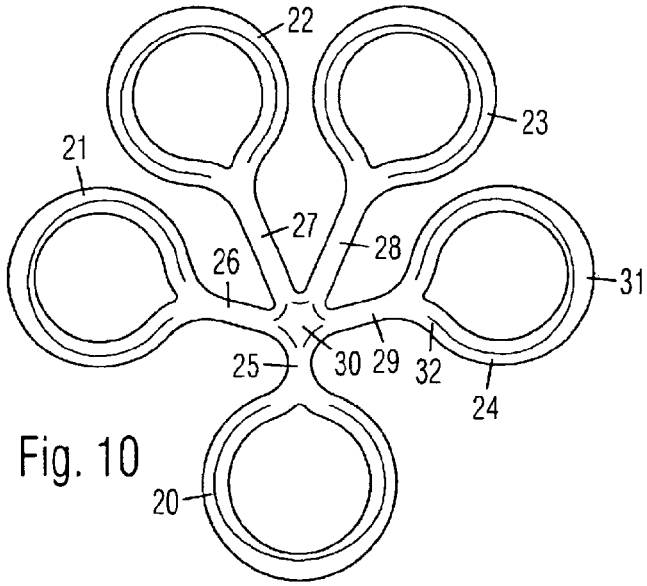
FIG. 10 is a top view of the embodiment of FIG. 9.
Figure 11:
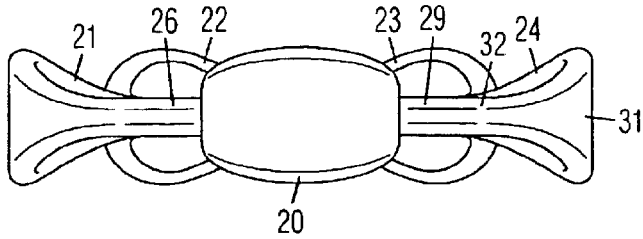
FIG. 11 is a side view of the embodiment of FIG. 9.

FIGS. 9–11:

A third embodiment of the finger exercise device is shown in FIGS. 9–11. It is comprised of a plurality of loops 20–24 for being respectively worn around the tips of the fingers and thumb. Radial arms 25–29 extending from a solid junction 30 are connected to the inner ends of respective loops 20–24. Solid junction 30 provides uniform force distribution. As shown in the top view in FIG. 10, arm 25 is preferably the shortest, and arms 27 and 28 are preferably the longest for properly positioning the fingers and thumb. Each loop has a gripping outer end 31 which is wider than an inner end 32 for improved grip and comfort around the finger. Arms 25–29 are narrower than the wide gripping outer ends of loops 20–24 for providing a suitable amount of tension. The thickness of arms 25–29 may be varied for providing suitable tension. Although each arm is shown as a single member, it may be comprised of plural members.

Figure 12:
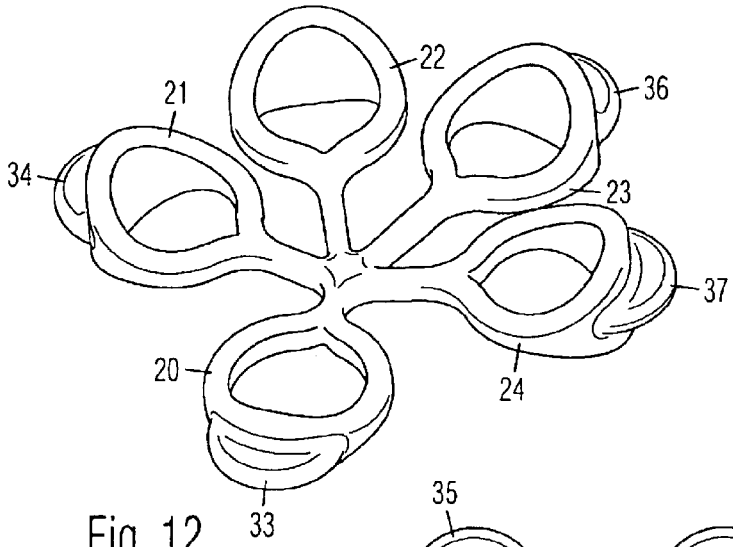
FIG. 12 is a perspective view of a fourth embodiment thereof.
Figure 13:
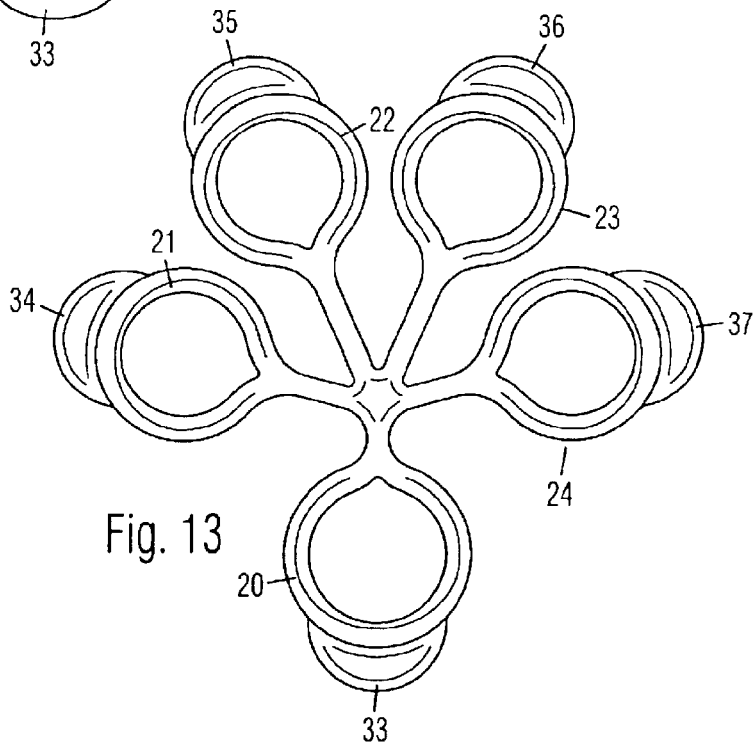
FIG. 13 is a top view of the embodiment of FIG. 12.
Figure 14:
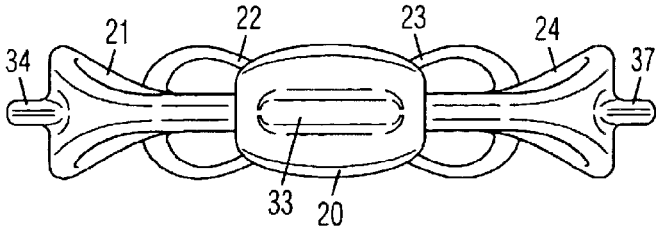
FIG. 14 is a side view of the embodiment of FIG. 12.

FIGS. 12–14:

A fourth embodiment of the finger exercise device is shown in FIGS. 12–14. It is comprised of the same loops 20–24 as in FIGS. 9–11, but further including tabs 33–37 projecting from respective gripping outer ends of loops 20–24. Tabs 33–37 provide easily grasped surfaces when adjusting the positioning of loops around the fingers.

Figure 15:
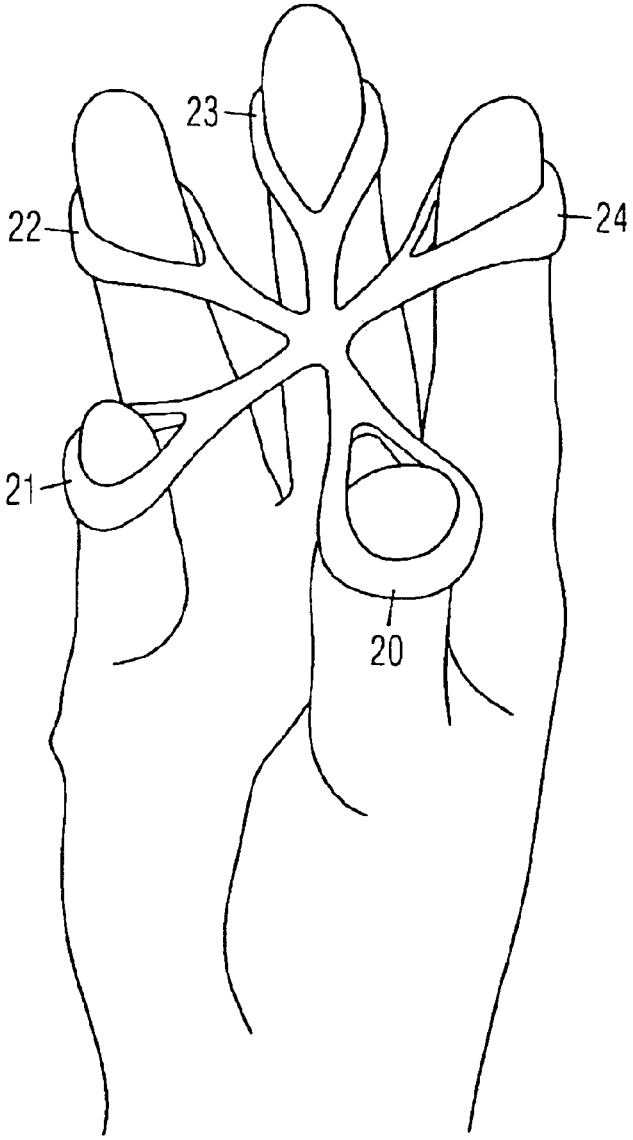
FIG. 15 shows the finger exercise device of FIG. 9 in use.

FIG. 15:

The finger exercise device of FIGS. 9–11 is shown in FIG. 15 in use. Loops 20–24 are worn around the thumb and all the fingers, which are repeatedly spread apart against the tension of the exercise device as physical therapy or to maintain good health.

Figure 16:
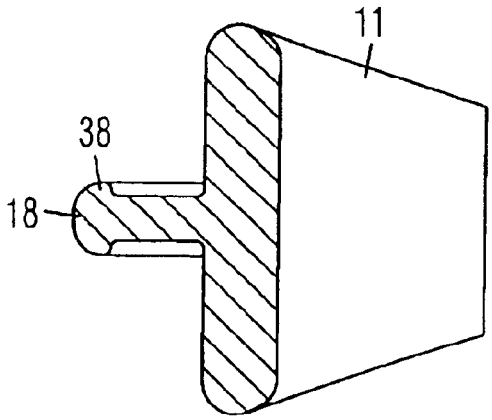
FIG. 16 is a sectional view of a tab of the finger exercise device.

FIG. 16:

A tab is shown in a sectional view in FIG. 16. It includes raised rims 38 on opposite surfaces for improving grip. Tab 18 is shown as an example, but the tabs in all other embodiments are the same.

Although the foregoing description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

We claim:

1. A finger exercise device, comprising:

an elastic loop for being worn around a plurality of fingers to provide tension when the fingers are spread apart, said loop having a varying width between opposite edges thereof, wherein said loop includes a plurality of wider gripping ends and a narrower intermediate portion, said wider gripping ends are arranged for facilitating grip and comfort around the fingers, and said intermediate portion is arranged for providing tension between said gripping ends; and tabs extending from respective gripping ends for being grasped when positioning said loop around the fingers, wherein each of said tabs includes raised rims on opposite surfaces for improving grip.

2. A finger exercise device, comprising:

an elastic central loop for being worn around a plurality of fingers to provide tension when the fingers are spread apart, said central loop having a varying width between opposite edges thereof, wherein said central loop includes a plurality of wider gripping ends and a narrower intermediate portion, said wider gripping ends are arranged for facilitating grip and comfort around the fingers, and said intermediate portion is arranged for providing tension between said gripping ends; and elastic side loops attached to respective gripping ends of said central loop for being worn around said fingers, wherein each of said side loops includes a varying width between opposite edges thereof, and a gripping outer end which is wider than an inner end which is attached to a corresponding gripping end of said central loop.

3. The finger exercise device of claim 2, further including tabs extending from respective gripping outer ends of said side loops for being grasped when positioning said side loops around the fingers.

4. The finger exercise device of claim 2, further including tabs extending from respective gripping outer ends of said side loops for being grasped when positioning said side loops around the fingers, wherein each of said tabs includes raised rims on opposite surfaces for improving grip.

5. A finger exercise device, comprising:

a plurality of loops for being respectively worn around a plurality of fingers and a thumb, each of said loops having a varying width between opposite edges thereof, wherein a gripping outer end of said each of said loops is wider than an inner end for facilitating grip and comfort around the fingers; and radial arms extending from a solid junction for facilitating force distribution, wherein outer ends of said arms are connected to respective inner ends of said loops.

6. The finger exercise device of claim 5, further including tabs extending from respective gripping outer ends of said loops for being grasped when positioning said loops around the fingers.

7. The finger exercise device of claim 5, further including tabs extending from respective gripping outer ends of said loops for being grasped when positioning said side loops around the fingers, wherein each of said tabs includes raised rims on opposite surfaces for improving grip.

* * * * *